United States Patent [19]

DiVito

[11] 4,006,900

[45] Feb. 8, 1977

[54] MAGNETIC BASEBALL, BAT AND GLOVE

[76] Inventor: Joseph A. DiVito, 10 Alden Ave., Hull, Mass. 02045

[22] Filed: Feb. 5, 1975

[21] Appl. No.: 547,111

[52] U.S. Cl. ..... 273/95 R; 273/58 R; 273/26 B; 2/19

[51] Int. Cl.[2] ..... A63B 71/02

[58] Field of Search ..... 2/19, 161 A; 273/1 M, 273/58 R, 95 R, 96 R, 102 R, 102 B, 25, 26 R, 26 B

[56] References Cited

UNITED STATES PATENTS

| | | | |
|---|---|---|---|
| 1,056,909 | 3/1913 | King | 2/19 |
| 1,064,914 | 6/1913 | Jones | 273/1 M |
| 1,496,824 | 6/1924 | Nixon | 2/19 |
| 1,633,926 | 6/1927 | Craig | 2/19 |
| 2,219,074 | 10/1940 | Guillou | 273/1 M |
| 2,562,089 | 7/1951 | Fishlove | 273/102 R |
| 2,590,002 | 3/1952 | Frazier | 273/1 M |
| 2,745,666 | 5/1956 | Swartz | 273/95 R |
| 3,137,504 | 6/1964 | Zordan | 273/26 B |
| 3,141,173 | 7/1964 | Jackson | 273/25 |
| 3,365,839 | 1/1968 | Luchsinger | 273/1 M |

FOREIGN PATENTS OR APPLICATIONS

| | | | |
|---|---|---|---|
| 1,227,368 | 10/1966 | Germany | 273/1 M |

*Primary Examiner*—Anton O. Oechsle
*Assistant Examiner*—Marvin Siskind

[57] ABSTRACT

Baseball apparatus including a bat, ball and glove; wherein they are magnetically arranged such that the ball is attracted to the glove and bat in such a manner that the players may hold the bat extended with the ball affixed to it, disconnect it quickly with a slight jerk, strike the ball, and cause it to go directly to the baseball glove. A player can catch with the bat also as well as pick the ball up with the bat again jerk it slightly freeing the ball from the bat and strike it toward a player having another bat or glove which attracts the ball to the pocket of the glove, or the end of the corresponding bat.

1 Claim, 5 Drawing Figures

MAGNETIC BASEBALL, BAT AND GLOVE

This invention relates to toys more particularly to toys involved in baseball, softball and the like.

Little children, particularly 4 or 5 years of age, are unable to play baseball effectively because they cannot catch a ball nor can they strike the ball with a bat effectively. The present invention provides a ball that is attracted magnetically to a glove whereby an adult can throw a ball to a child wearing a baseball glove in accordance with the present invention, and the ball is attracted to it such that he is able to catch the ball easily, and once caught he is able to hold on to it. This encourages the boy in the development of his coordination and the game of "catch" becomes quite enjoyable for both the parent and child.

In accordance with this invention also, the inventor has discovered that a bat can be treated at its tip magnetically and have the end hollowed out such that it will receive a ball which is also magnetically treated and held very neatly in place at the end of the bat. The bat can then be used to pick up a ball and even catch a ball. However, more importantly the ball can be jerked slightly, such that it is released from the bat, and the player can then strike at the ball causing it to be directed to another person with a similar bat, and they are able to bat the ball back and forth in play. Or a glove according to the above paragraph can be utilized such that the other player can catch the ball, particularly a very young child.

Therefore an object of the present invention is to provide a magnetically arranged bat, ball and glove for play.

Another object of the present invention is to arrange a light weight plastic bat in combination with a light weight plastic ball which are attracted to one another and mate at the extreme end of the bat.

Another object of the present invention is to provide a baseball glove and ball which are attracted to one another magnetically such that players may catch a ball more easily and hold it in glove pocket when caught.

Another object of the present invention is to arrange a game having two bats hollowed out at the end for receiving a magnetically treated ball, whereby they can bat the ball back and forth catching it with the bat as well as striking it back to the other player.

Other objects features, and advantages of the present invention will be better understood when read in conjunction with the attached specification and drawings of which:

Figure 1:
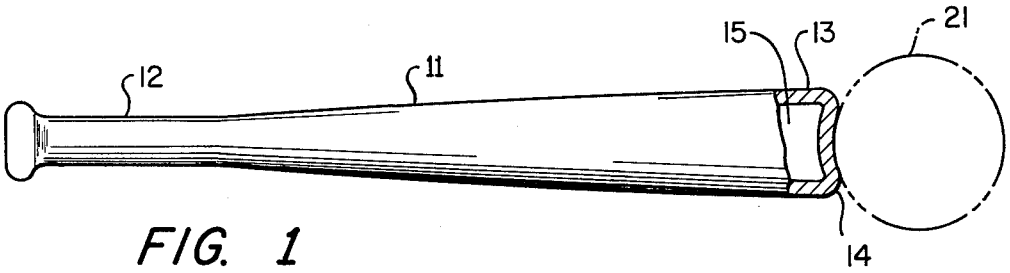
FIG. 1 is a bat in accordance with the present invention.

Referring now to FIG. 1 we see a bat in accordance with the present invention 11. It has a handle in the conventional manner 12. However, end 14 is hollowed out to receive phantom ball 21. We also note that the tip surface 13 is treated with magnetic material, such that it will attract a ball having been magnetically treated with iron filings, as will be explained more fully as we proceed. The bat 11 is a conventional bat of the usual type having a hollowed out area 15 that has been blow-molded and sold as a toy for a substantial period of time.

Figure 2:
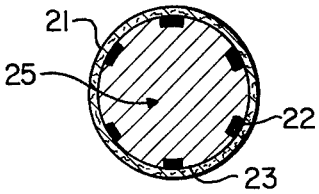
FIG. 2 is a ball in accordance with the present invention.

Referring now to FIG. 2 we see a ball 21. It is hollowed out such as plastic balls similar to the bat, and is also blow molded from plastic. It has a hollowed out surface 25. Magnetic material 22 and 23 can be added to the inside of the ball or iron filings can be mixed with the plastic materials such that it will defuse throughout the material and produce a very useful magnetically attractable ball. In FIG. 1 it is shown in phantom fitting into the end of bat 14.

Figure 3:
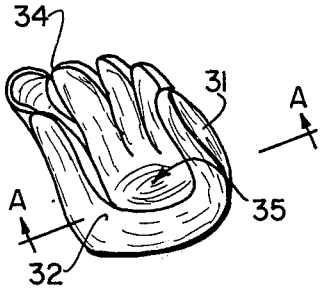
FIG. 3 is a glove in accordance with the present invention.

Referring to FIG. 3 we see a catchers mitt 31, having a thumb 32 end finger ends 34. It has a pouch where a ball is received at 35.

Figure 4:
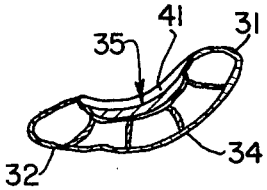
FIG. 4 is a sectional view of the gloove in FIG. 3.

In FIG. 4 we see sectionally that underneath the pouch pocket 35 a magnet 41 which has been installed there and attracts the ball very easily. The players hand will slide in between the magnet and the finger section 32 and 34, as shown by the section AA.

Figure 5:
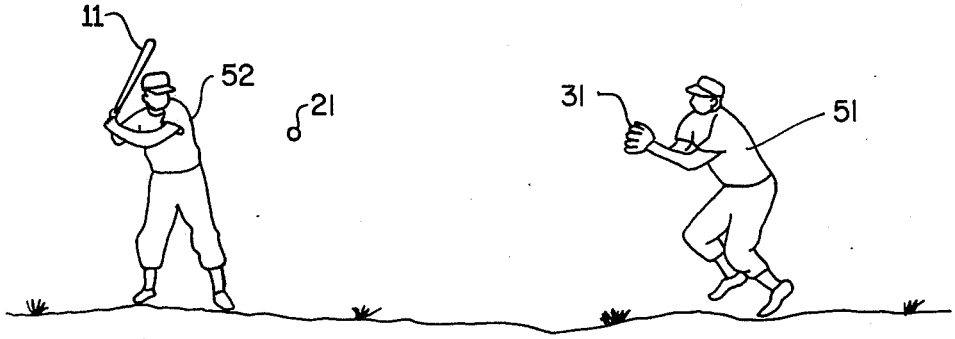
FIG. 5 shows an adult and child playing with the above toys.

Referring now to FIG. 5 we see a player 52 with his bat in his hand and ball. He has just struck 21 which goes to a child 51, who has a glove in his hand 31. The ball when it gets in the range of the player will be attracted to the glove, and once it enters the pocket of the glove it will stay there. The player will obviously feel that he is able to catch it and hold onto it, and will thereby develop his coordination in accordance with the tremendous encouragement that success breeds in being able to play ball like a big boy.

Older boys and adults may wish to bat the ball back and forth to one another improving their swing and deriving the pleasure and entertainment that such activity can provide. The ball 21 and two bats 11 would be used. The magnetically attracted ball would be picked up by one of the players in the hollowed out end 14 of his bat. He would then jerk the bat slightly flipping the ball up in the air and then swinging the bat he would strike the ball. The ball would then go toward the other player with a similar bat. The other player would extend the end of his bat to catch the ball in the cup at the end of his bat magnetically. The second player would then jerk the ball into the air; swing at it; strike it; thereby sending it to the player as the game continued back and forth. It can be seen then, that parents with their young children can develop skills and coordination by utilizing the present invention. Moreover, they can play catch with older boys and also bat balls back and forth between one another deriving substantial entertainment value, as well as batting practice in accordance with the present invention.

Although I have described my invention with reference to specific apparatus, I do not wish to be limited thereby. Those skilled in the art may make many variations and substitutions without departing from the true, scope, and spirit. I wish only to be limited by the appended claims.

I claim:

1. A magnetic baseball game comprising in combination:

a hollow plastic ball having iron filings dispersed throughout the shell of said ball, magnetic attracting baseball glove means having a magnet within the ball receiving pouch of said glove for receiving and catching said ball, a plurality of plastic bats having ball receiving pouches at one end of each bat with a magnet therein for attracting and holding said ball, such that a player may hold said bat with both hands, place a ball within the pouch, raise the bat into position, jerk it, strike the ball when released and catch the ball when thrown or struck back to him.

* * * * *